United States Patent [19]

Evans et al.

[11] Patent Number: 4,552,228

[45] Date of Patent: Nov. 12, 1985

[54] LOW PRESSURE DIFFERENTIAL COMPENSATOR

[75] Inventors: Robert F. Evans, Dallas; Charles W. Stafford, Arlington, both of Tex.

[73] Assignee: Varel Mfg. Co., Dallas, Tex.

[21] Appl. No.: 581,612

[22] Filed: Feb. 21, 1984

[51] Int. Cl.[4] ..... E21B 10/24

[52] U.S. Cl. ..... 175/228; 175/339

[58] Field of Search ..... 175/228, 339, 371, 359

[56] References Cited

U.S. PATENT DOCUMENTS

| | | | |
|---|---|---|---|
| 3,721,306 | 3/1973 | Sartor | 175/228 |
| 4,161,223 | 7/1979 | Oelke | 175/228 |
| 4,276,946 | 7/1981 | Millsapps, Jr. | 175/228 |
| 4,358,384 | 11/1982 | Newcomb | 175/228 |
| 4,407,375 | 10/1983 | Nakamura | 175/228 |
| 4,448,268 | 5/1984 | Fuller | 175/228 |

FOREIGN PATENT DOCUMENTS

| | | | |
|---|---|---|---|
| 2332737 | 8/1974 | Fed. Rep. of Germany | 175/228 |

*Primary Examiner*—Stephen J. Novosad
*Assistant Examiner*—William P. Neuder
*Attorney, Agent, or Firm*—Harold E. Meier

[57] ABSTRACT

A low pressure differential compensator for use in a lubrication system having a lubricant reservoir is provided, the reservoir providing lubricant to a bearing area between relatively rotatable elements having a seal therebetween. In particular, the low pressure differential compensator includes a flexible elongated diaphragm having a plurality of longitudinally-extending ribs which expand radially with respect to the longitudinal axis of the reservoir in response to the pressure differential across the seal. The radially collapsing and expanding flexible diaphragm is free operating and has no inherent restrictions which require increased pressure to overcome. Therefore, the pressure differential across the seal is minimized, increasing the effective life of the seal.

8 Claims, 3 Drawing Figures

LOW PRESSURE DIFFERENTIAL COMPENSATOR

TECHNICAL FIELD

The present invention relates generally to pressure compensation devices and, in particular, to a low pressure differential compensator for tools and equipment having seals between relatively rotating parts.

BACKGROUND OF THE INVENTION

Rotating seals used in tools and equipment which operate in high hydrostatic pressure environments require a pressure equalizing element. For example, rotary rock bits having an o-ring packing seal between each rotary cutter and journal pin thereof typically include a lubrication system. The system includes a reservoir filled with a lubricant, passages to communicate the reservoir with the bearing area between each rotary cutter and journal pin, and a flexible diaphragm pressure compensator. The diaphragm is positioned within the reservoir to limit the pressure differential between the lubricant and the pressure in the well bore. In operation, a portion of the flexible diaphragm moves axially within the reservoir to equalize the pressure differential between the lubricant reservoir pressure and the bore hole fluid pressure, therefore minimizing the pressure differential across the o-ring seal. Such lubrication systems often advantageously include a high pressure relief valve to relieve the excess lubricant pressure developed during the heating and/or raising and lowering of the drill bit.

Lubrication systems incorporating axially-expanding diaphragms have proven generally effective for equalizing the pressure across a rotating seal. However, as seen in U.S. Pat. No. 4,276,946 to Millsaps, Jr., such diaphragms are typically cup-shaped and thus include folded sidewalls. Because of this diaphragm structure, an additional force, i.e., the force required to "roll" these sidewalls, must also be overcome before the bottom of the diaphragm can move axially. Moreover, such cup-shaped diaphragms may not operate properly if the cup moves offcenter with respect to the longitudinal axis of the reservoir. In such systems, the lubricant differential pressure is often greater than 20 psi during normal operating conditions. Most types of o-ring packing seals perform best with small pressure differentials, i.e., on the order of 10 psi. Seals which run at minimal pressure differentials have greater effective lives when required to withstand high surface velocities or higher ambient temperatures which are encountered in deep drilling. Moreover, such cup-shaped diaphragms may not operate properly if the cup moves off-center with respect to the longitudinal axis of the reservoir. Therefore, there is a need for an improved diaphragm structure which is free operating and has no inherent restrictions which require increased pressure to overcome.

SUMMARY OF THE INVENTION

A low pressure differential compensator is provided for use in tools and equipment required to operate in high hydrostatic pressure environments. By way of example only, the low pressure differential compensator may be used in a sealed lubricated rotary rock bit of the type having a lubricant reservoir disposed within the bit body and communicating with a bearing area between each rolling cutter and journal pin of the bit. In accordance with the invention, the pressure compensator comprises a flexible elongated diaphragm located within the lubricant reservoir, the diaphragm having a plurality of circumferentially-spaced, longitudinally-extending ribs with flexible surfaces therebetween. Due to this structure, the diaphragm expands radially with respect to the longitudinal axis of the reservoir in response to a pressure differential across a sealing element between each rolling cutter and journal pin. In a preferred embodiment of the invention, the flexible elongated diaphragm comprises a plurality of circumferentially-spaced, longitudinally-extending ribs having flexible surfaces therebetween. In contradistinction to the axially-expanding diaphragm of the prior art, the flexible elongated diaphragm is free operating and has no inherent restrictions which require increased pressure to overcome. This diaphragm reduces the pressure differential across the sealing element to less than 10 psi during normal operating conditions, thus increasing the effective life of the seal.

The differential compensator may be advantageously employed in a lubrication system having a high pressure relief valve to relieve excess lubricant pressure generated during the heating and/or raising and lowering of the drill bit.

BRIEF DESCRIPTION OF THE DRAWINGS

For a more complete understanding of the present invention and advantages thereof, reference is now made to the following Description taken in conjunction with the accompanying Drawings in which.

DETAILED DESCRIPTION

Figure 1:
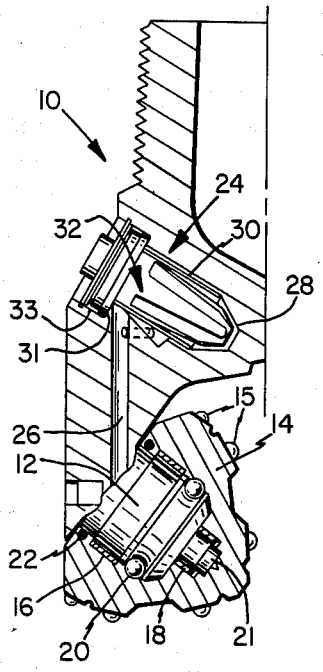
FIG. 1 is a sectional view of the lubrication system in one leg of a rotary rock bit incorporating the low pressure differential compensator of the present invention.

Referring now to the Drawings wherein like reference characters designate like or similar parts throughout the several views, FIG. 1 is a sectional view of one leg 10 of a rotary rock bit incorporating the low pressure differential compensator of the present invention. The leg 10 forms part of a bit body and includes a depending journal pin 12 which extends inwardly for engaging the bearing surfaces of a rotatable cutter 14 journaled thereon. The rotatable cutter includes a plurality of cutting elements 15, typically tungsten carbide inserts. A bearing assembly including friction bearings 16 and 18, ball bearings 20, and thrust button 21, is provided for allowing the cutter 14 to rotate with respect to the journal pin 12. An o-ring packing seal 22 is located at the back face of the cutter 14 for preventing bore hole fluid from entering the bearing area between the rotatable cutter 14 and the journal pin 12, and also for preventing lubricant from leaking past to the bore hole.

Figure 2:
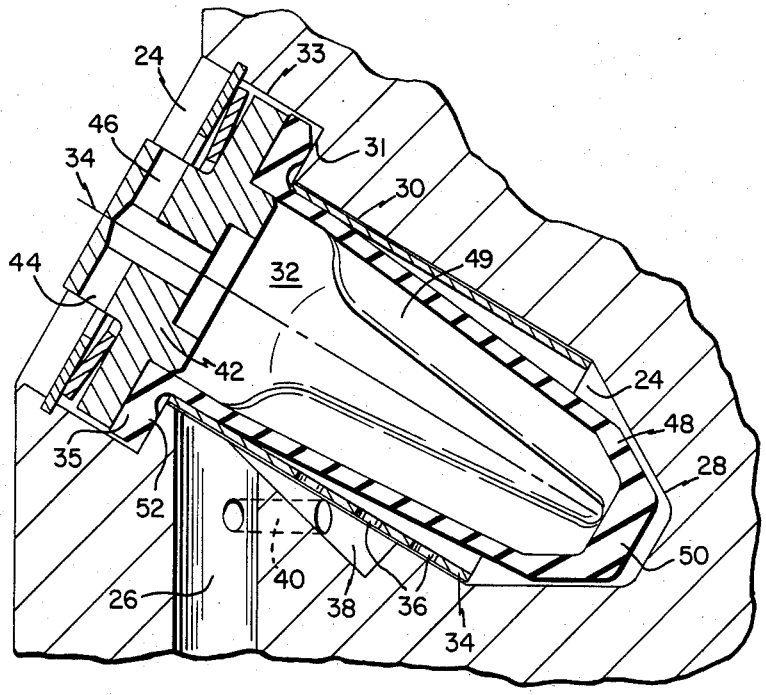
FIG. 2 is an enlarged partial cross-sectional view of the low pressure differential compensator of the drill bit of FIG. 1.

Referring simultaneously to FIGS. 1 and 2, each leg 10 includes a lubrication system comprising a reservoir 24 communicating via a passageway 26 with the bearing area between the journal pin 12 and the rotatable cutter 14. The reservoir 24, which includes a lubricant, comprises a generally conical-shaped base 28, a lower sidewall 30, a sealing wall 31, and an upper sidewall 33. Passageways, not shown, are located within the journal pin 12 connecting the passageway 26 with the friction bearings 16 and 18, ball bearings 20 and the thrust button 21. According to the present invention, a low pressure differential compensator comprising a flexible elongated diaphragm 32 is mounted within the reservoir 24 to equalize the pressure differential across the o-ring packing seal 22. As will be described in more detail below, the flexible elongated diaphragm expands radially with respect to the longitudinal axis 34 of the reservoir 24 in response to pressure differential across the seal 22.

Referring specifically now to FIG. 2, an enlarged cross-sectional view of the low pressure differential compensator of the present invention is shown in detail. In particular, the flexible elongated diaphragm 32 is spaced from the lower sidewall 30 of the reservoir 24 by a metal sleeve 34. The sleeve 34, which prevents the upper end 35 of the diaphragm from extruding into the lower portion of the reservoir, includes apertures 36 therein through which the lubricant passes. A small connecting chamber 38 abuts the reservoir 24 and a passageway 40 connects the chamber 38 to the passageway 26. A cover cap 42 is attached to the upper end 35 of the flexible elongated diaphragm 32 and includes passageways 44 and 46 for exposing the interior of the diaphragm to the exterior pressures acting on the rock bit. The external side of the flexible elongated diaphragm 32 is exposed to the lubricant pressures. In operation, the diaphragm limits the pressure differential between the lubricant and the pressure in the well bore. More specifically, the flexible diaphragm moves radially with respect to the longitudinal axis 34 of the reservoir 24 to equalize the pressure differential between the lubricant reservoir pressure and the bore hole fluid pressure, therefore minimizing the pressure differential across the o-ring seal 22.

Figure 3:
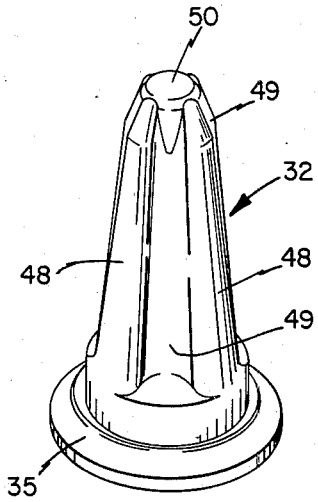
FIG. 3 is a perspective view of the flexible elongated diaphragm of the present invention.

Referring simultaneously to FIGS. 2 and 3, the operation of the low pressure differential compensator of the present invention will now be described in detail. In particular, the flexible elongated diaphragm 32 comprises a plurality of circumferentially-spaced, longitudinally-extending ribs 48 having flexible surfaces 49 therebetween. These ribs are integrally formed in the diaphragm and are tapered with respect to the upper end 35 thereof. In the preferred embodiment of the invention, the diaphragm is formed of a flexible molded rubber. The longitudinally-extending ribs 48 terminate in a bottom end 50 of the diaphragm.

Prior art axially-expanding diaphragms are generally cup-shaped, and thus movement thereof requires lubricant differential pressures often greater than 20 psi during normal operating conditions. This is because an additional force, i.e., the force required to bend the sidewalls thereof, must be overcome before the bottom of the diaphragm can move axially. Moreover, such cup-shaped diaphragms do not function properly if the cup drifts offcenter with respect to the longitudinal axis of the reservoir. Since o-ring seals perform best with small pressure differentials, the use of such axially-expanding diaphragms tends to increase the wear of the seal. To ameliorate this problem, the flexible surfaces 49 of the diaphragm of the present invention are designed to expand radially, rather than axially, with respect to the longitudinal axis of the reservoir in response to the pressure differential across the seal. In particular, due to the elongated structure of the diaphragm 32 of the present invention, there is no additional bending force which must be overcome before the diaphragm expands or contracts. Also, since the diaphragm expands radially through expansion of the flexible surfaces 49, more surface thereof is normally exposed to the pressure differential, thus requiring less movement of the diaphragm. The radially collapsing and expanding flexible diaphragm is thus free operating and has no inherent restrictions which require increased pressure to overcome. Lubrication systems utilizing the elongated diaphragm of the present invention generate pressure differentials on the order of 10 psi across the seal. Seals which run at such low pressure differentials have greater effective lives when required to withstand the higher surface velocities or higher ambient temperatures encountered in deep drilling.

Therefore, in accordance with the present invention, a flexible elongated diaphragm is provided for expanding radially with respect to the longitudinal axis of a lubrication system reservoir in response to pressure differentials across a sealing element. Because of this radial expansion, the effective pressure differential across the seal is minimized, thus increasing the effective life of the seal.

Referring back to FIG. 2, the lubrication system may also include a high pressure relief valve for relieving excess lubricant pressures generated during the raising and lowering of the drill bit. In particular, the cover cap 42, along with the diaphragm 32, is floatingly mounted within the reservoir 24. A belleville spring 54 which is mounted between the cover cap 42 and a snap ring 56 engagable with the upper sidewall 33 of the reservoir 24, biases the cover cap 42 and a sealing lip 52 of the diaphragm 32 against the sealing wall 31 of the reservoir. This pressure relief valve functions to relieve the excess lubricant pressure generated during heating and/or the raising and lowering of the drill bit. When such pressures are generated, the spring force of the belleville spring 54 is overcome to unseat the sealing lip 52 from the sealing wall 31 of the reservoir 24. Also, internal pressures can be manually vented without removing the cover cap 42 by slightly prying the cap to unseat the contour 52.

A low pressure differential compensator comprising a radially expanding diaphragm has therefore been provided by the present invention. Although the diaphragm has been shown incorporated in a lubrication system for a rotary rock bit, it can be advantageously utilized in any type of tool or equipment having pressure equalizing elements required to operate in high hydrostatic pressure environments. The radially collapsing and expanding flexible diaphragm of the present invention is free operating and has no inherent restrictions which require increased pressure to overcome. Therefore, the pressure differential across the sealing element is minimized and the effective life thereof increased.

Although the invention has been described and illustrated in detail, it is clearly understood that the same is by way of illustration and example only and is not to be taken by way of limitation. The spirit and scope of this invention are to be limited only by the terms of the appended claims.

We claim:

1. A low pressure differential compensator for use in a sealed rotary rock bit of the type having at least one leg forming part of a bit body, the leg having a journal pin for rotatably supporting a rotatable cutter, said rotatable cutter and journal pin having a seal therebetween, comprising:

a lubricant reservoir disposed within said bit body and communicating with a bearing area between said rotatable cutter and said journal pin, and a flexible elongated diaphragm of a truncated cone shape configuration where the walls of the cone have opposed longitudinally extending linear crests, each crest having opposite sloping surfaces, each surface joining the sloping surface of the adjoining crests to form an undulatory cross section, said diaphragm located within said lubricant reservoir for separating said reservoir into a lubricant region and a borehole fluid region, said diaphragm extending radially with respect to the longitudinal axis of said reservoir in response to a pressure differential across the seal.

2. The low pressure compensator as described in claim 1 wherein said longitudinally-extending crests are integrally formed in the diaphragm.

3. The low pressure differential compensator as described in claim 1 wherein the diaphragm includes an upper end portion having a raised contour on its outer peripheral surface.

4. A low pressure differential compensator for use in a sealed rotary rock bit having a lubrication system including a lubricant reservoir, the reservoir providing lubricant to a bearing area between relatively rotatable elements having a seal therebetween, comprising:

a flexible elongated diaphragm of a truncated cone configuration where the walls of the cone have opposed longitudinally extending linear crests, each crest having opposed sloping surfaces, each surface joining the sloping surface of the adjoining crest to form an undulatory cross section, said diaphragm located within said lubricant reservoir for separating said reservoir into a lubricant region and a borehole fluid region, said diaphragm expanding radially with respect to the longitudinal axis of said reservoir in response to a pressure differential across said seal.

5. The low pressure differential compensator as described in claim 4 wherein said diaphragm includes an upper end portion having a contour surface on its outer peripheral surface for forming a high pressure relief valve.

6. A low pressure differential compensator as described in claim 5 wherein said lubrication system includes a cover cap attached to said upper end, said cover cap having passages formed therein for communicating the exterior of said rock bit with the interior of said diaphragm.

7. The low pressure differential compensator as described in claim 6 wherein said lubrication system further includes means for biasing said cover cap and said outer peripheral surface of said diaphragm against a sealing wall of said reservoir.

8. The low pressure differential compensator as described in claim 7 wherein said means for biasing includes a belleville spring biased against said cover cap by a snap ring secured in an upper wall of said reservoir.

* * * * *